US006474922B2

(12) United States Patent
Bachman et al.

(10) Patent No.: US 6,474,922 B2
(45) Date of Patent: Nov. 5, 2002

(54) REMOTE OPERATION AUXILIARY HOIST CONTROL AND PRECISION LOAD POSITIONER

(75) Inventors: John A. Bachman, Dana Point; James E. Crawford, Santa Ana, both of CA (US)

(73) Assignee: Del Mar Avionics, Irvine, CA (US)

( * ) Notice: Subject to any disclaimer, the term of this patent is extended or adjusted under 35 U.S.C. 154(b) by 0 days.

(21) Appl. No.: 09/853,403

(22) Filed: May 10, 2001

(65) Prior Publication Data

US 2002/0043510 A1 Apr. 18, 2002

Related U.S. Application Data

(60) Provisional application No. 60/203,430, filed on May 10, 2000.

(51) Int. Cl.[7] ..... B66C 13/40

(52) U.S. Cl. ..... 414/21; 212/278; 212/283; 212/285; 294/905

(58) Field of Search ..... 212/278, 282, 212/283, 285; 414/21; 294/905

(56) References Cited

U.S. PATENT DOCUMENTS

| | | | | | |
|---|---|---|---|---|---|
| 3,025,702 | A | | 3/1962 | Merrill et al. | 73/143 |
| 3,110,177 | A | | 11/1963 | Merrill et al. | 73/143 |
| 4,539,174 | A | * | 9/1985 | Patenaude | 376/261 |
| 5,072,184 | A | * | 12/1991 | Dessaux | 294/82.15 |
| 5,125,707 | A | * | 6/1992 | Chaen et al. | 294/82.15 |
| 5,209,361 | A | * | 5/1993 | Grubb | 414/21 |
| 6,241,298 | B1 | * | 6/2001 | Whyte et al. | 294/905 |
| 6,241,462 | B1 | * | 6/2001 | Wannasuphoprasit et al. | 414/21 |

* cited by examiner

*Primary Examiner*—Thomas J. Brahan
(74) *Attorney, Agent, or Firm*—W. D. English, Esq.

(57) ABSTRACT

An electromechanical, remotely operated Auxiliary Hoist Control and Precision Load Positioner system and device is disclosed utilizing a Radio Frequency Hand Controller transceiver Unit distal to a Radio Frequency Hoist Controller Transceiver Unit for raising and lowering a large, heavy, bulky, fragile, or expensive piece of equipment by very gradual means to avoid hang ups that might otherwise destroy or seriously damage the equipment.

2 Claims, 14 Drawing Sheets

REMOTE OPERATION AUXILIARY HOIST CONTROL AND PRECISION LOAD POSITIONER

This invention emanates from and relates back to an earlier filing of a Provisional Patent Application, No. 60/203,430, filed May 10, 2000, and titled Wireless Remote Data Communications and Control System, designating John Bachman and James Crawford as joint inventors.

FIELD OF THE INVENTION

This invention relates to auxiliary hoist controls. More particularly, the invention relates to an auxiliary hoist control and position load positioner which may be utilized to raise and lower large, bulky, or heavy objects over short distances and can accurately position the objects with respect to the vertical. More specifically, the invention discloses a Radio Frequency, remote controlled, load positioner heretofore unavailable in the prior art.

DESCRIPTION OF THE PRIOR ART

Precision load positioners and auxiliary hoist controls have been previously used in connection with hoists, such as a block and tackle, for the assemblage of heavy structures. An example of such a hoist control is illustrated in U.S. Pat. No. 2,500,459, issued to Hoover et al and assigned to Merrill et al. In such devices provision has been made for the control of hydraulic fluid in a piston cylinder arrangement connected to a load engaging means, whereby the load supported from the load engaging means is lowered by means of the by-passing of hydraulic fluid around the piston in the cylinder. Such devices failed to gain widespread acceptance as auxiliary hoist control devices.

Another auxiliary hoist control and precision load positioner was disclosed in U.S. Pat. Nos. 3,025,702 and 3,110,177, issued to Merrill et al and assigned to applicant herein. The Merrill patents provide positive control over the lowering and raising of extremely heavy loads supported by the control. However, since the raising and lowering mechanisms of the device were mechanically operated levers mounted on the hoist control device itself, it became apparent when lifting large, bulky or fragile loads that a need existed for a remotely controlled load positioner to be able to more conveniently control the precision load positioner when lifting very large, bulky or fragile bodies where access to the auxiliary hoist control is very difficult if not totally inaccessible.

It is conceived that loads of several hundred tons could be accurately positioned with the load positioner disclosed herein by increasing the size of the load positioner and by increasing the number of load positioners to distribute and support a relatively large, bulky or heavy load.

In the load positioner utilized in the Merrill prior art and in the present invention, a valve assembly provides for the controlled escape of that portion of the hydraulic fluid which supports the piston within the cylinder. The hydraulic fluid escapes through the valve assembly into an annular storage chamber. The storage chamber is divided into two portions by a separator ring. The lower portion of the storage chamber contains the escaped hydraulic fluid. The upper portion of the storage chamber is sealed from both they hydraulic fluid and the external atmosphere. Air or other compressible fluids are contained in the upper storage chamber. As the hydraulic fluid escapes from the cylinder into the lower storage chamber, the separator ring is forced upward so as to compress the fluid stored in the upper storage chamber. This compression of the fluid in the upper storage chamber provides a method of retaining the balance of pressures throughout the system and for returning the piston to its original, retracted position.

The valve assembly is of novel construction and also functions to permit the passage of hydraulic fluid so as to equalize the pressures within the cylinder and in the annular storage area when the load is removed. In other words, when the load is removed, the valve assembly, which previously acted to allow passage of fluid from the cylinder to the annular storage area, now functions automatically as a dump valve to allow passage of fluid from the annular storage area to the cylinder. This valve assembly is hereinafter referred to as the "down valve."

A pump is provided in the load positioner to furnish means for returning the piston to its retracted position when a load is engaged. The pump withdraws hydraulic fluid from the storage chamber and injects the fluid into the cylinder, thereby forcing the piston upward. This pump is hereinafter referred to as the "up pump."

The present invention fully incorporates and improves on the foregoing Merrill art, also owned by applicant, and in doing so solves a long standing need by disclosing a Radio Frequency (RF), remote control capability for an auxiliary hoist control precision load positioner that is necessary for fragile or expensive loads that are also large or bulky loads and that are difficult if not impossible to monitor in moving or in performing an assembly.

SUMMARY OF THE INVENTION

The invention is an RF remote control auxiliary hoist control precision load positioning device and system. A transceiver controller unit is attached to an existing precision load positioner and is coupled by RF means to a transceiver hand control unit in the hands of an operator a safe distance away from the load and the load positioner, as well as the supporting crane. On power up, the dual transceivers are set in constant two way communication with each other with redundant circuits and an Emergency Stop override button for "fail safe" requirements. The system software and firmware is set up to run an automated calibration and self check on power up and enables operator through various Menus and Screen Displays to control or to change default functions for various variables of interest such as Load Linear Travel, Load Deviation, Load Weight, Command Verification. Various buttons on the Hand Control Unit allow the operator to program the system by remote means, and load lifting and lowering is commanded by simple two way movement of a Joystick on the Hand Unit. By such means an operator can raise and lower a very heavy, bulky, fragile, or expensive load without incurring damage to the equipment being raised/lowered and without danger to the operator.

OBJECTS OF THE INVENTION

It is therefor a primary object of the invention to offer an auxiliary hoist control, precision load positioner system and means operable by remote means;

Another object is to provide a load positioning system that can be operable remotely without interference from dust, debris, intervening equipment or structures, or visibility day or night.

It is another object to provide for a remote control load positioner device and system operated by RF means.

Another object of the invention is to provide a redundant "fail safe" load positioner with Emergency Stop override features.

Another object is to provide for an intelligent, microprocessor operated precision load positioning system.

Another object is to provide for an electromechanically operated load positioner system.

Another object is to provide for a programmable load positioning system that can be automated to limit human involvement.

DETAILED DESCRIPTION OF A PREFERRED EMBODIMENT

Figure 1:
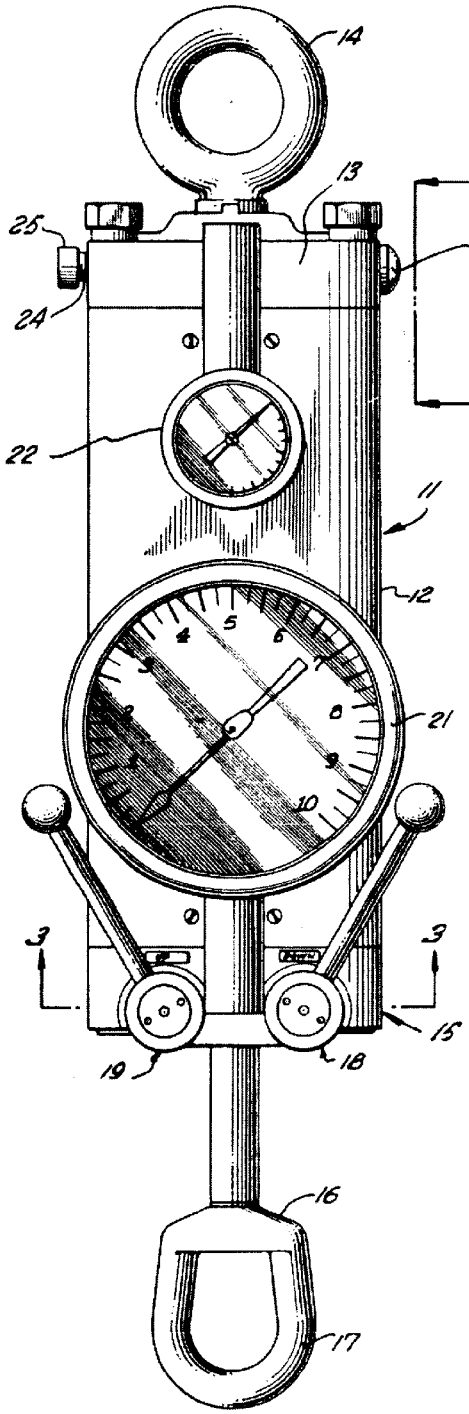
FIG. 1 is a front elevation of a mechanically operated auxiliary hoist control.
Figure 1A:
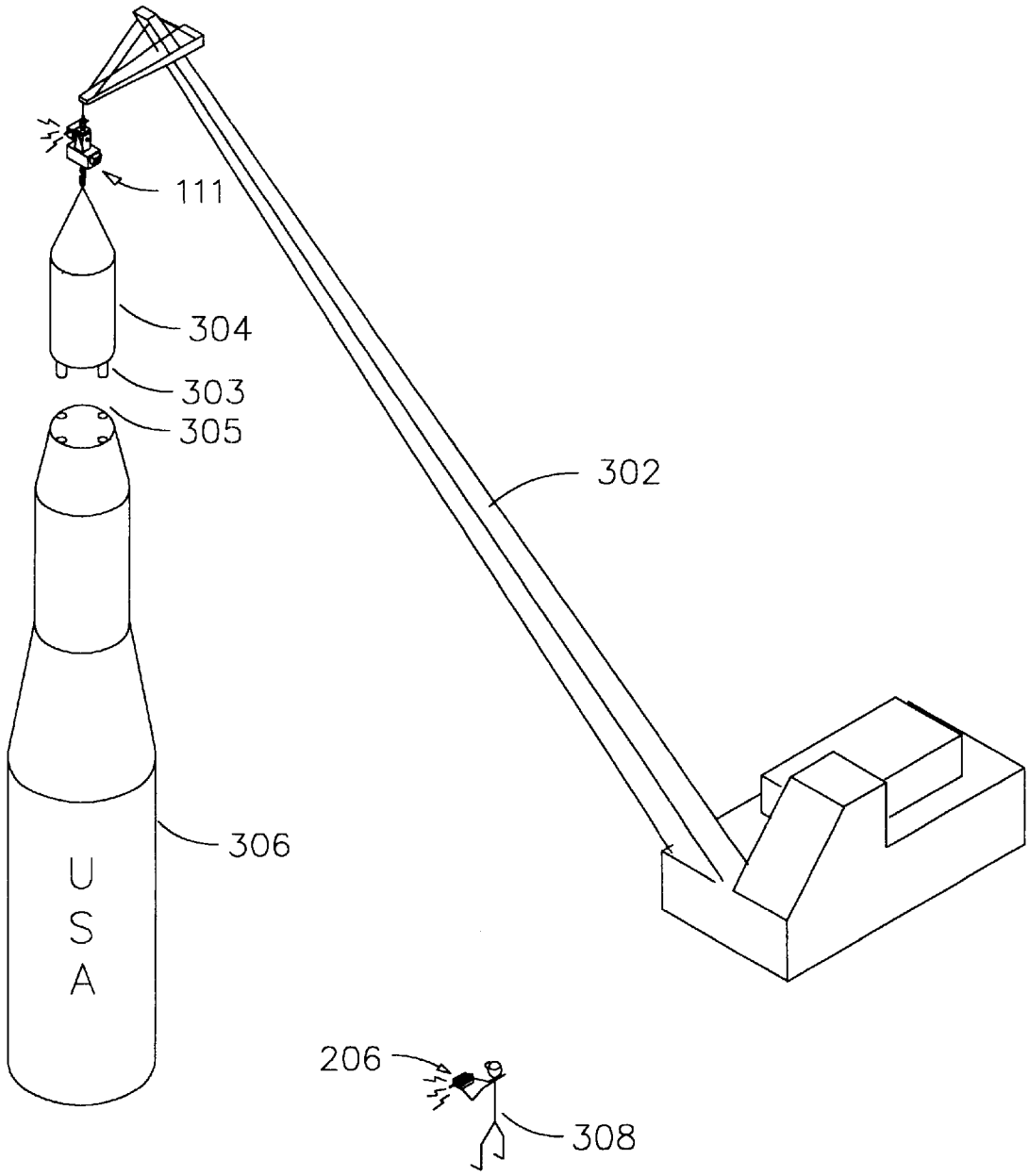
FIG. 1*a* is a perspective depiction of a typical load lifting environment wherein the remote control load lifting system of the present invention would be effective.

FIG. 1*a* depicts a perspective view of a real world application of the remote control load positioner system. The remote control load positioner device 111 is illustrated as attached to and supported by a crane 302. The remote control load positioner 111 is controlled by RF control means in hand control unit 206. By such means a the cone element 304 of a multi stage rocket 306 can very gently lowered to slide bolt elements 303 into slots 305 without binding, hanging up or damaging the rocket components.

Referring to FIG. 1, there is shown an auxiliary hoist control 11 which consists principally of a body portion 12, and upper head 13, to which a top eye 14 is connected, and a lower head 15. A rotatable socket having a lower eye 17 is connected to a shaft extending through the lower head 15. The lower head 15 has a down valve assembly 18 and an up pump assembly 19 extending there through. A hydraulic fluid pressure gauge 21 and a compressible fluid pressure gauge 22 are located on the body portion 12 of the auxiliary hoist control. A compressible fluid filler plug 25 closes a compressible fluid addition inlet (see FIG. 2). A breather cap 26 vents the space above the piston to the atmosphere through a passage 27 (see FIG. 2) in the upper head.

Figure 2:
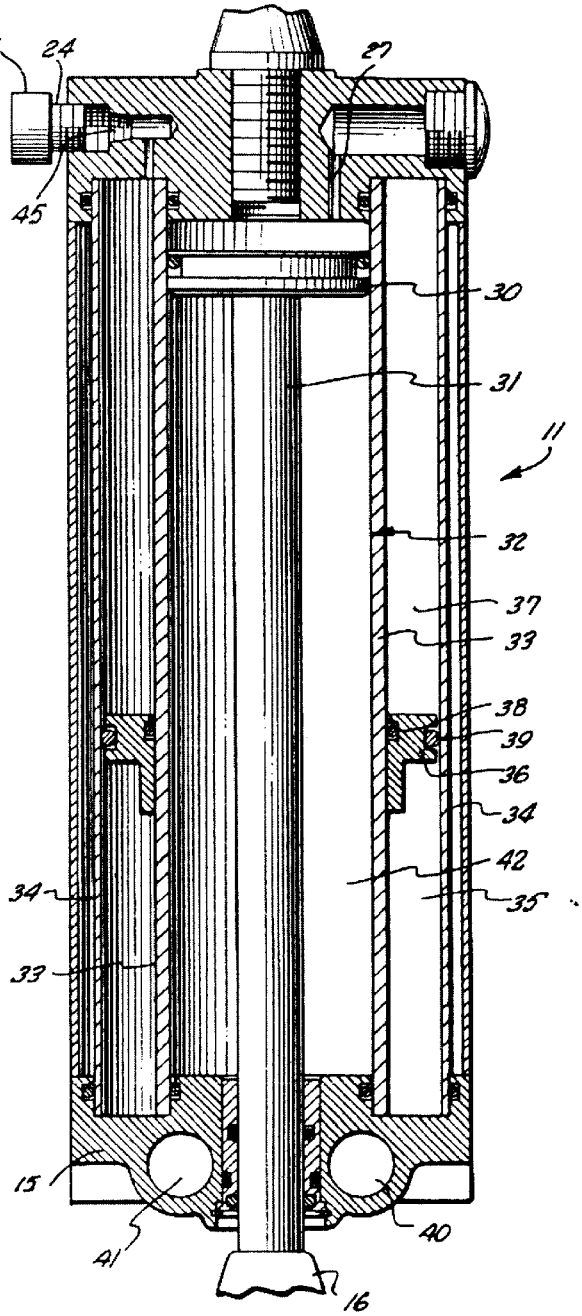
FIG. 2 is a front elevation in section of FIG. 1.

FIG. 2 shows a sectional elevation of the auxiliary hoist control 11 of FIG. 1. A piston 30 is connected to a piston rod 31, the lower end of which is attached to the lower eye 17. The piston is inserted in a cylinder 32 having a wall 33. Concentric about the cylinder 32 there is positioned a second cylinder 34 so as to form a concentric annular volume with respect to the cylinder 32. This annulus has a lower portion 35 which is divided by a solid brass separator ring 36 from an upper portion 37. The lower portion 35 is used as, and hereinafter referred to as, the hydraulic fluid storage area. The upper portion 37 is used as, and hereinafter referred to as, the compressible fluid storage area. The separator ring 36 has an inner O-ring 38 and outer O-ring 39 which assist in forming a seal between the two storage areas.

A down valve assembly bore 40 and an up pump assembly bore 41 are located in the lower head assembly 15.

Figure 3:
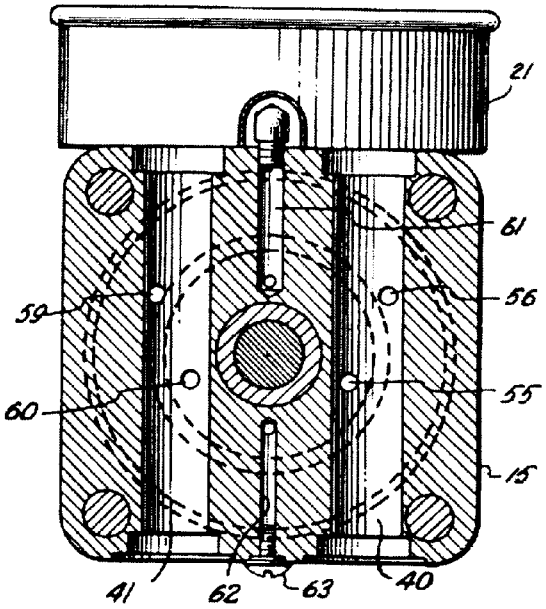
FIG. 3 is a sectional view taken along lines 3—3 of FIG. 1 with the down valve assembly and up pump assembly removed.
Figure 5:
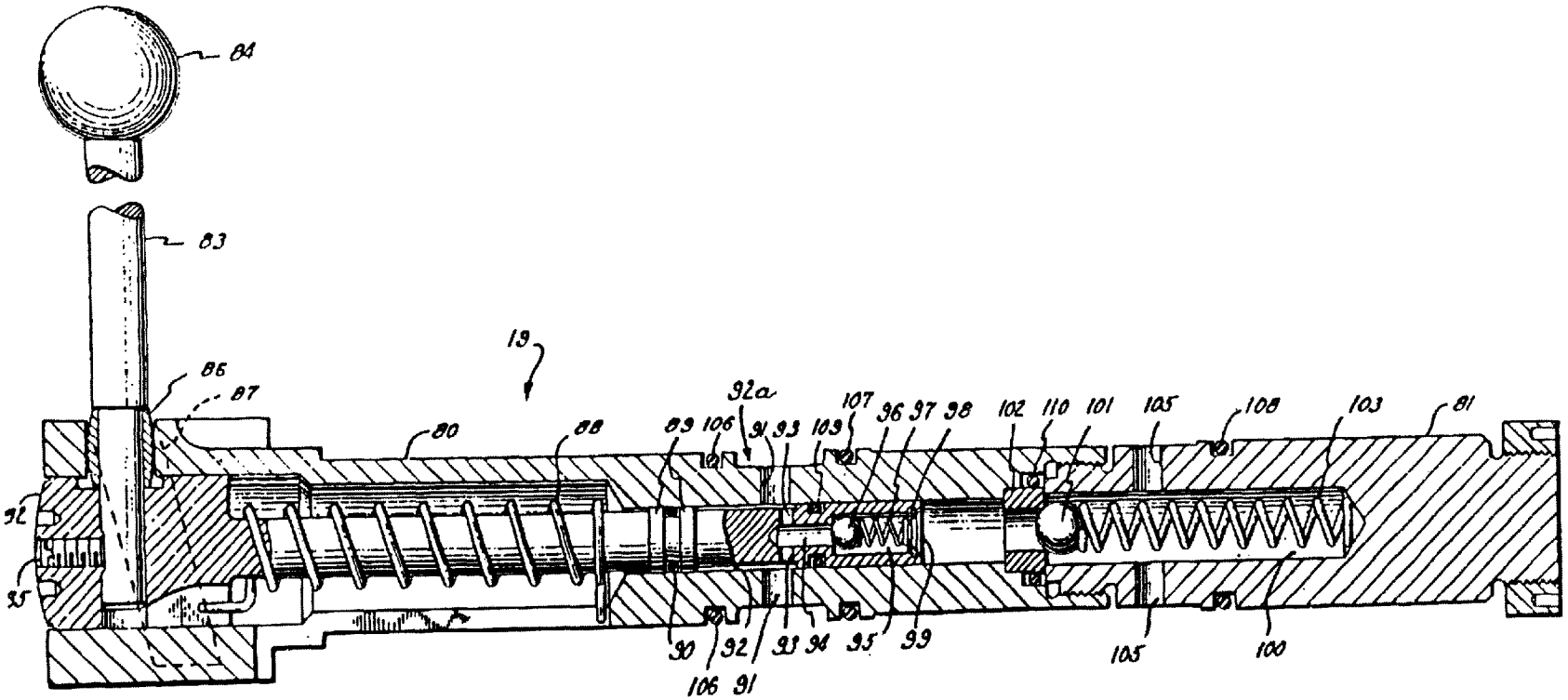
FIG. 5 is a sectional view of the up pump of the auxiliary hoist control.
Figure 6:
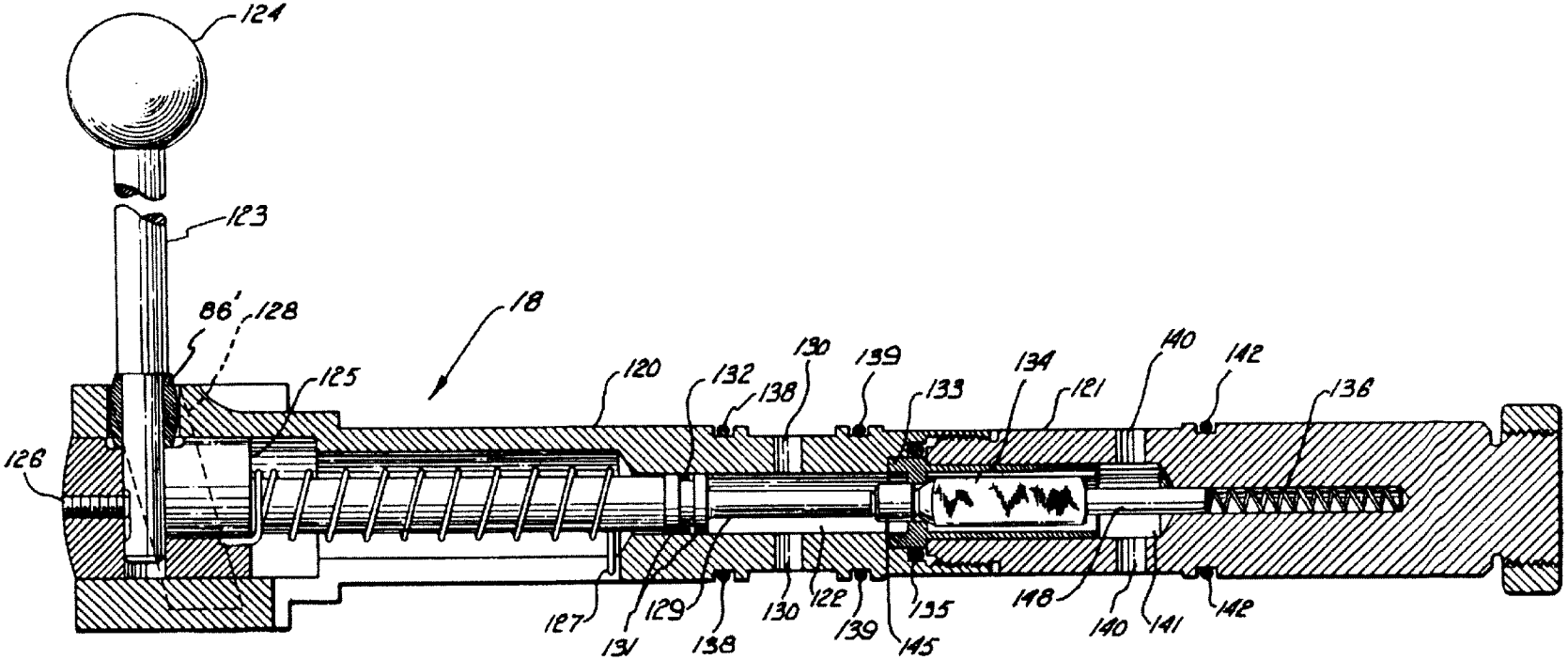
FIG. 6 is a section view of the down valve of the auxiliary hoist control.

FIG. 3 is a sectional view of the lower head 15. Two bores 40 and 41 contain the down valve assembly 18 and the up pump assembly 19 respectively, which assemblies are not shown in FIG. 3 for purposes of clarity. Partial sections of these assemblies are shown in FIGS. 5, and 6. A down valve assembly inlet hole 55 and outlet hole 56 provide apertures for by-passing hydraulic fluid from the cylinder into the hydraulic fluid storage area by means of the down valve assembly. Up pump inlet and outlet holes 59 and 60 provide apertures for withdrawing hydraulic fluid from the storage area and injecting the fluid into the cylinder in conjunction with the up pump assembly 19. A gauge passage 61 connects the cylinder to the hydraulic fluid pressure gauge 21. A hydraulic fluid addition passage 62 is closed by a cap 63.

Hydraulic fluid is contained in the inner cylinder 32. When a tensioning load is applied between the top eye 14 and the lower eye 17, the hydraulic pressure exerted by the hydraulic fluid in the inner cylinder 32 increases. Through the action of the down valve assembly, as will subsequently be described, this hydraulic fluid is selectively passed from the inner cylinder 32 into the hydraulic fluid storage area 35. A decrease in volume of hydraulic fluid contained in the inner cylinder 32 due to the movement of the piston 30 in response to the tensioning load, will result in the movement of the piston rod 31 out of the lower head assembly 15 in proportion to the amount of hydraulic fluid passed into the hydraulic fluid storage area 35.

An increase in volume of the hydraulic fluid stored in the hydraulic fluid storage area 35 will move the separator ring 36 in a direction toward the upper head 13. Air or other compressible fluid is normally stored in the compressible fluid storage area 37. The movement upward of the separator ring 36 will compress the fluid stored in the compressible fluid storage area 37 in proportion to the amount of movement of the separator ring 36 which occurs, and therefore in proportion to the amount of hydraulic fluid transferred from the cylinder 32 to the hydraulic fluid storage area 35.

The auxiliary hoist control 11 is so constructed that there is an appreciable difference between the cross sectional area of the storage areas 35 and 37 and the cross sectional area of the cylinder 32. The proportioning of these cross sectional areas permits the ultimate capacity of the unit to be widely varied so long as the structural limitations of the unit are not exceeded.

For example, assuming that there is a 1:2 ratio between the storage cross section and the cylinder cross section areas, the force which the compressible fluid will be required to exert on the separator ring, and consequently, on the hydraulic fluid, in order to exactly counterbalance a 20,000 pound tensioning force applied across the auxiliary hoist 11 will be only 10,000 pounds. If the cross section area of the cylinder 32 is 50 square inches, when the compressible fluid has been compressed to a pressure of 400 pounds per square inch, the system will be in equilibrium.

Assuming that the piston and piston rod are in their fully retracted position, the position shown in FIG. 2, and the compressible fluid in the upper annular area is at atmospheric pressure, when the piston is subsequently moved toward the lower head 15 by a tensioning force of 20,000 pounds, the system will be in equilibrium when the compressible fluid is compressed to approximately one twenty-fifth of its original volume.

However, if the pressure existing in the compressible fluid area is appreciably greater than ambient pressure when the piston 30 and piston rod 31 are in their fully retracted position, the application of a tensioning load of 20,000 pounds will cause the required 10,000 pounds pressure to be exerted by the compressible fluid upon the separator ring prior to the piston travel required for equilibrium in the preceding case. Thus, by pre-pressuring the upper annular storage area, it is possible to limit the ultimate extension of the auxiliary hoist in accordance both with the tension load applied and with the pre-pressuring used.

Pre-pressuring of the compressible fluid storage area may be accomplished through a compressible fluid inlet 45 (FIG. 2). By means of this pre-pressuring facility, the auxiliary hoist control may be also utilized as a tension measuring device. Thus, knowing the pressure initially existing in the compressible fluid area, the tension exerted may be measured by the amount of extension of the piston rod.

Figure 4:
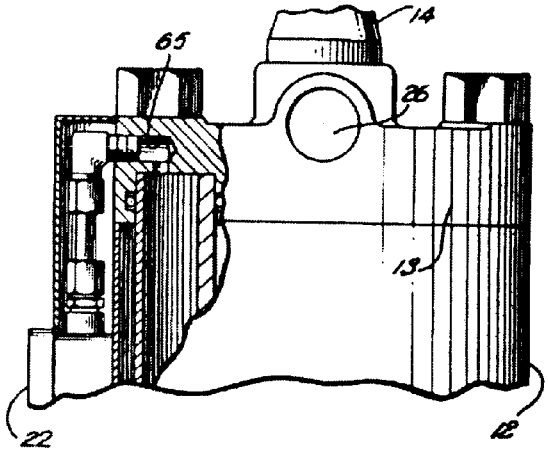
FIG. 4 is a fragmentary elevation taken along lines 4—4 of FIG. 1, partially in section.

FIG. 4 is an elevation, partially in section, showing the upper head 13. A compressible fluid gauge outlet passage 65 connects the compressible fluid gauge 22 to the upper annular storage area.

FIG. 5 is a sectional view of the up pump assembly 19. The up pump assembly consists of a hollow body portion 80 to which is connected an extension body 81 at one end and a piston 82 at the other. A pump handle 83 having a knob 84 extends into the body of the piston 82 and is held in position by a set screw 85. A handle bearing 86 holds the handle 83 generally in position in the up pump body 80 and reduces friction due to handle movement. The up pump body 80 has a canted slot 87 indicated by the dotted line along which the handle 83 may be moved. A torsion spring 88 is connected between the piston and the pump body to rotatably return the piston to the position shown after it has been moved along the canted slot. Adjacent one end of the torsion spring 88 are a pair of flanges 89 which contain an O-ring 90. The hollow pump body 80 narrows adjacent the flanges 89 so that the flanges 89 and the O-ring 90 provide a seal. The hollow pump body 80 has a pair of hydraulic fluid inlets 91 extending there through. The portion of the piston 82 adjacent the hydraulic fluid inlets 91 is of smaller diameter than the inner diameter of the pump body 80 at that point, thereby providing an annular hydraulic fluid containing space 92. A second concentric hydraulic fluid containing space 92*a* obviates the necessity for aligning the inlets 91 with the inlet 59 (see FIG. 3) of the lower head.

In the annular hydraulic fluid containing space 92, the piston has a pair of hydraulic fluid inlet passages 93 which open into a longitudinal storage passage 94 within the piston 82 so as to form a small hydraulic fluid storage space. The longitudinal passage 94 opens onto a larger diameter ball check valve passage 95. In the ball section valve passage 95 there is contained a ball 96 held in position by means of a ball check spring 97 so as to close the longitudinal storage passage 94. The ball check spring 97 is held in compression by means of a washer 98 positioned against a snap ring 99 which engages the outer surface of the ball check valve passage 95.

The extension body 81 has a hollow cylindrical central portion 100 and contains a ball 101 which is held against a check valve seat 102 in the form of a ring by a check valve spring 103. The ball 101 and check valve spring 103 are contained within the hollow central body portion 100 of the body extension 81 when the up pump 19 is assembled. Two hydraulic fluid outlet holes 105 extend from the outer surface of the extension body 81 into the hollow central portion 100. A first O-ring 106, in cooperation with the cylindrical bore 41 of the lower head and a shoulder on the pump body 80, seals the hydraulic fluid contained in the annular storage area in one direction. A second O-ring 107 provides a hydraulic fluid seal between the inlet holes 91 and the outlet holes 105. A third O-ring 108 provides a seal for the hydraulic fluid contained adjacent the extension body 81.

An O-ring 109 seals the surface between the piston and body next to the inlet holes 93 in the direction of the extension body 81. An O-ring 110 seals the junction of the check valve 102, the extension body 81, and the pump body 80.

The up pump is operated by rotating the up pump handle 83. Due to the canted construction of the slot 87 which contains the handle 83, the piston 82 is driven toward the extension body 81 when the pump handle 83 is so rotated. Hydraulic fluid from the annular storage cylinder fills the inlet holes 91 and annular volume 92 associated therewith, together with the check valve inlet holes 93 and longitudinal storage passage 94. The hollow volume extending between the first ball 96 and the second ball 101 is filled with hydraulic fluid. The movement of the piston 82 towards the extension body 81 compresses this latter volume of hydraulic fluid to a pressure which exceeds the pressure existing in the cylinder 32. When the pressure exerted on this compressed volume between the check balls 96 and 101 exceeds the combined pressure existing in the cylinder 32 and the pressure exerted on the ball 101 by the check valve spring 103, the ball 101 moves against the check valve spring 103 to the extent required to compress the spring 103 to equalize for the excess in pressure existing in the fluid between the trapped check balls. However, the movement of the check ball 101 against the check ball spring 103 moves the check ball 101 away from the check valve seat 102 which the check ball 101 formerly sealed. Thereupon, the fluid trapped between the two check balls escapes through the outlet holes 105 into the annular volume existing between the up pump assembly and the cylindrical bore 41 of the lower head 15 and then into the cylinder 32 through the up pump outlet hole 60 (see FIG. 3). Hydraulic fluid will continue to so flow until the pressure existing in the fluid between the two check balls and the pressure existing in the fluid between the two check balls and the pressure existing in the cylinder is equalized. Thereupon, the ball 101 will be forced against the check valve seat 102 by the check valve spring 103, again sealing hydraulic fluid between the two check balls.

Release of the pump handle 83 allows the torsion spring 88 to return to the pump handle 83 to its normal position and retract the piston 82 from the advanced position resulting from the prior rotating movement of the pump handle. Retraction of the piston 82 reduces the pressure on the fluid trapped between the two check balls. Check ball 101 remains seated against the check valve seat 102 due to the pressure exerted by the fluid in the hollow central portion 100 of the extension body 81 against the ball 101. The ball 96 which heretofore closed the longitudinal passage 94 by the action of the compressed fluid trapped between the two check balls and also by the action of the check valve spring 95, is now moved away from the valve seat by the pressure exerted on the ball 96 by the fluid contained in the holes 91 and 93 and the longitudinal passage 94. When the hydraulic fluid contained between the two check balls 96 and 101 is at a pressure equal to that of the hydraulic fluid storage area 35, the ball 96 is moved by the check valve spring 97 to close the longitudinal passage 94.

Thus, fluid is extracted from the annular storage area and passed through the holes 91, 93 and the passage 94 around the check ball 96 and into the volume contained between the check balls 96 and 101. A subsequent movement of the pump handle, as previously described, will thereupon result in the repetition of the pumping cycle which was described above.

FIG. 6 is a sectional view of the down valve assembly 18. The down valve assembly 18 consists of a body 120 and a body extension 121 which together contain the various parts of the valve. A down valve handle 123 having a knob 124 inserted through the body 120 into the hollow central portion thereof. A valve actuator 125 is contained in the hollow central portion 122 of the body 120 and engages the handle 123. The handle 123 is held against the valve actuator 125 by means of a set screw 126. A torsion spring 127 is contained within the hollow cylindrical portion of the body 120 and is operable to return the valve handle 123 to the position shown when it has been rotated. A canted slot illustrated by the dotted line 128 allows the valve handle 123 to be rotated. A handle bearing 86'holds the handle 123 generally in position in the down valve assembly 120 and reduces friction due to handle movement. Rotation of the valve handle causes the actuator 125 to move toward the body extension 121. The actuator has a stem portion 129 extending through the hollow central portion 122. A pair of outlet holes 130 extend through the body portion 120 and open into the hollow cylindrical central section 122. A seal of the hollow cylindrical central portion 122 in the direction of the valve handle 123 is formed by a pair of flanges 131 and an O-ring 133.

The annular chamber formed by the hollow cylindrical central portion 122 and the stem 129 has dimensions such that its longitudinal cross section area is at least three times greater than its lateral cross sectional area with the valve handle in the position shown. The use of this chamber configuration provides the proper location of the inlet and outlet holes for the valve. A helper spring 136 located in the extension 121 holds the valve piston 134 against the valve seat 133. An O-ring 138 seals the outlet holes 130 in the direction of the valve handle. An O-ring 139 seals the outlet holes in the opposite direction. A pair of inlet holes 140 open into a hollow central portion 141 of the extension 121 between the helper spring 136 and the valve seat 133. An O-ring 142 provides a seal adjacent the inlet holes 140.

Figure 7:
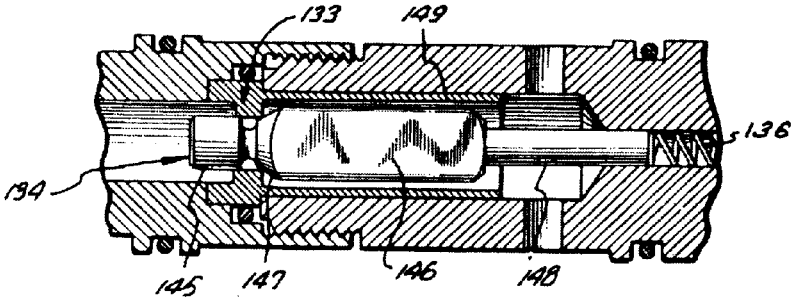
FIG. 7 is an enlarged partial sectional view of the down valve and piston, illustrated in FIG. 6.
Figure 8:
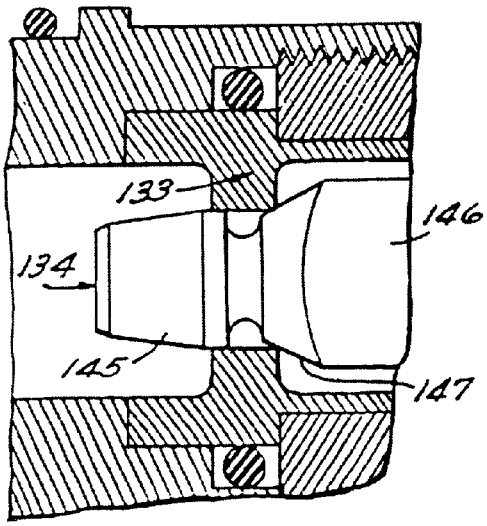
FIG. 8 is a further enlarged partial sectional view of the down valve and piston illustrated in FIG. 6.

FIG. 7 shows in detail the construction of the valve piston 134 and valve seat 133. The valve piston 134 consists of a piston head 145 which is connected to the main body portion 146 by a shoulder 147. A stem 148 extends from the main body portion 146 in the opposite direction from the piston portion 145. The piston head 145 has a slight narrowing taper in the direction away from the main body portion 146.

It should be noted that the valve piston consists of an integral unit contained within the valve seat 133. The valve seat 133 has an annular portion 149 extending down the main body portion 146. The main body portion 146 preferably is constructed of square stock having slightly rounded edges. With such a construction, the extended annular portion 149 of the valve seat 133 surrounding the body portion 146 serves to align the head portion 145 and shoulder portion 147 with the orifice of the valve seat 133, while the stem projecting from the body portion 146 in the opposite direction from the head portion 145 serves to provide firm contact with the helper spring 136 contained in the extension 121.

Referring to FIG. 6, the operation of the down valve assembly will now be described. The down valve handle is rotated along the canted slot 128, driving the actuator 125 in the direction of the extension 121. The stem of the actuator is in contact with the face of the valve piston head portion 145. Prior to movement of the down valve handle 123, the valve seat 133 and the valve piston shoulder 147 from a seal to prevent movement of fluid from the inlet holes 140 through the valve assembly toward outlet holes 130. The movement of the piston 134 caused by the actuator stem 129 driving the piston stem 148 against the helper spring 136 opens the seal formed between the shoulder 147 and the valve seat 133. However, the piston head 145 is contained within the orifice of the valve seat 133. A small annular by-pass area between the piston head portion 145 and the valve seat 133 exists. This small annular volume allows the movement of hydraulic fluid from the inlet holes 140 to the outlet holes 130. As the rotation of the valve handle 123 continues, the piston head portion 145 is moved further back within the valve seat orifice. After the portion of the valve head portion 145 adjacent the shoulder 147 passes completely through the orifice, further movement of the valve head portion in this direction will result in an increase in the annular cross section available for the passage of hydraulic fluid, due to the taper of the valve head portion 145. Therefore, the rate of passage of fluid through the down valve assembly is proportional to the amount of rotation of the down valve handle after the constant rate displacement of the piston head has been exceeded.

When the pressures existing between the hydraulic fluid in the cylinder and the hydraulic fluid in the annular storage chamber are equal, no flow of fluid through the down valve assembly will occur. If the valve handle 123 is thereupon returned to the position shown in FIG. 6, the helper spring 136 will force the piston shoulder 147 against the valve seat 133, thereby again sealing the annular storage chamber against a further introduction of fluid from the hydraulic fluid of the cylinder.

As was previously stated, the upper portion of the annular storage chamber contains a compressible fluid in a confined volume. When the tension causing the extension of the auxiliary hoist is removed, thereby releasing the pressure on the hydraulic fluid in the cylinder, the compressed fluid in the compressible fluid storage area 37 exerts a pressure on the hydraulic fluid in the hydraulic fluid storage area 35 which is greater than the pressure existing on the hydraulic fluid in the cylinder 32. The down valve assembly 18 thereupon commences to function as a dump valve due to its unique construction. The hydraulic fluid under high pressure in the hydraulic fluid storage area 35 forces the piston head 145 to retract through the valve seat 133 orifice. Hydraulic fluid flows from the hydraulic fluid storage area 35, through the outlet holes 130, the valve seat 133 orifice, the inlet holes 140 and into the cylinder 32. This flow of fluid continues until the piston and rod have been completely retracted or until the pressures exerted upon the separator ring by the compressible fluid and by the hydraulic fluid are equalized.

Figure 9:
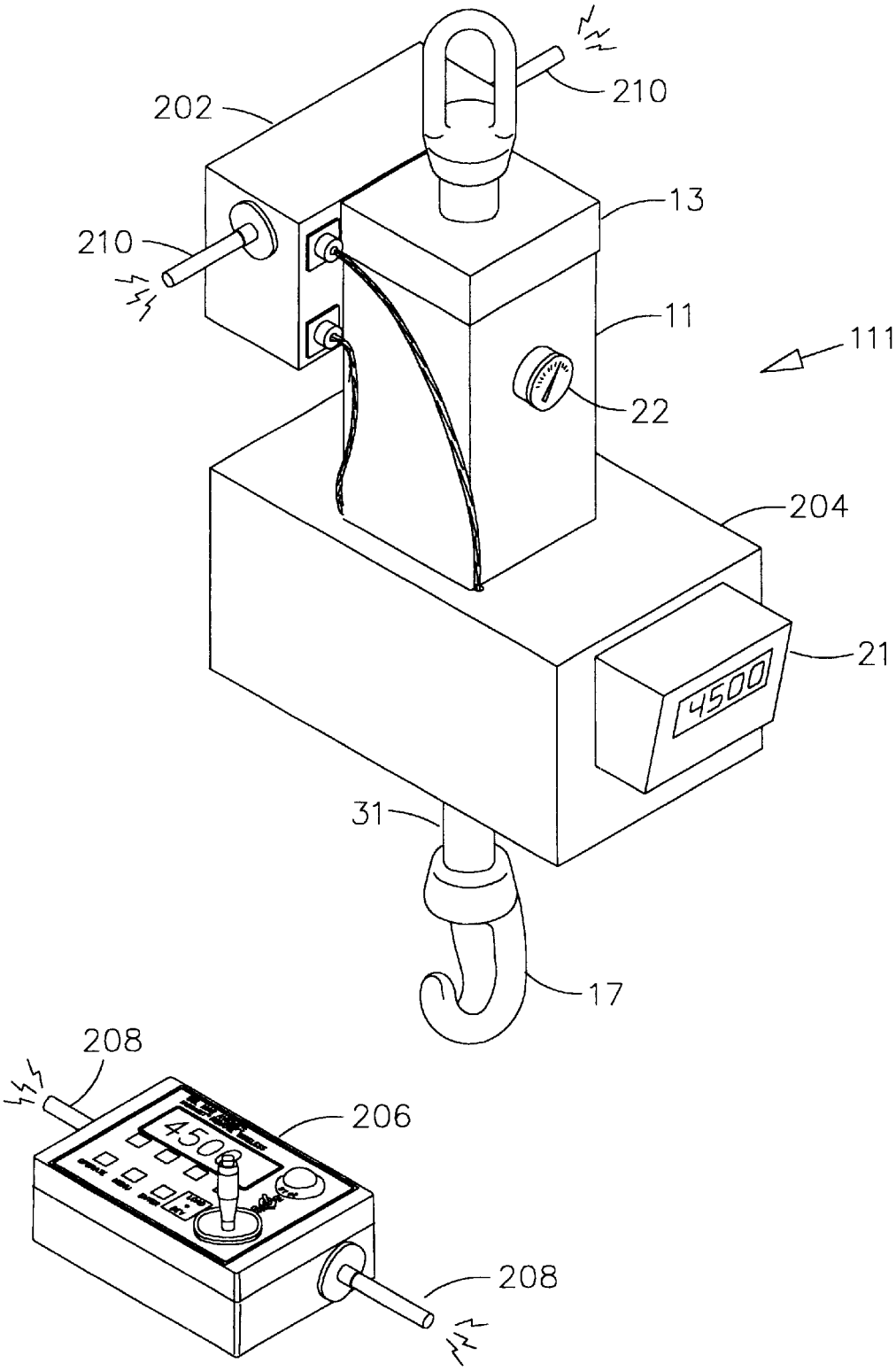
FIG. 9 is a perspective view of the improved RF remote auxiliary hoist control, precision load positioning system and apparatus illustrating the Hand Control Unit and the Load Positioner Controller Unit.
Figure 10:
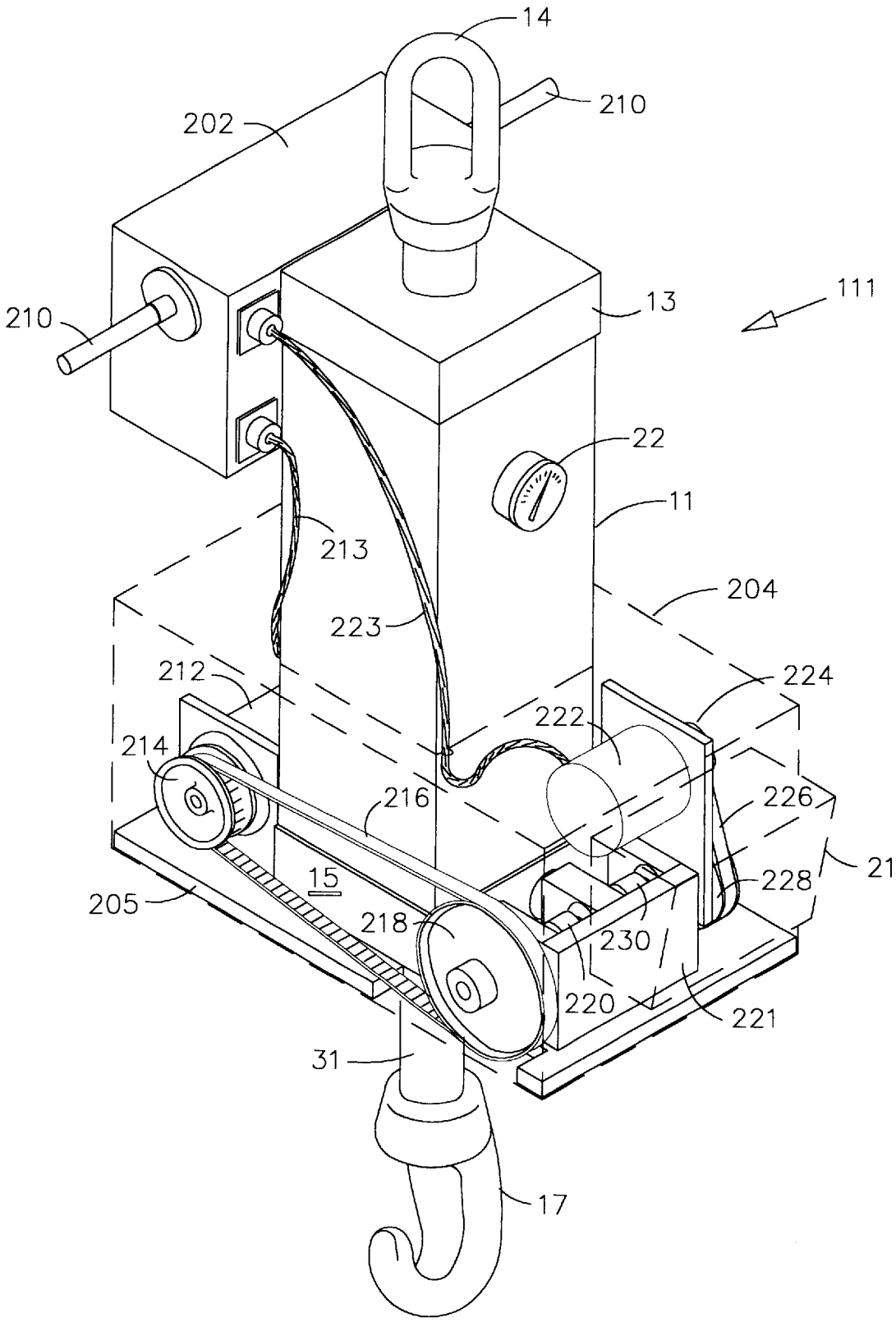
FIG. 10 is a transparent, perspective view of the Load Positioner Controller Unit.

Referring now to FIGS. 9 and 10, the new and improved remote control embodiment 11 of the auxiliary hoist control 11 is illustrated as having a rectangular exterior shaped body rather than the heretofore cylindrical shaped body of FIG. 1; however, the interior components therein are cylindrical and identical to that of FIG. 1, et seq. It should also be noted that the circular, analog hydraulic fluid pressure gauge 21 of FIG. 1 is replaced with a rectangular shaped digital hydraulic fluid pressure gauge 21. All other components of auxiliary hoist control 11 are identical to that delineated through FIGS. 1 through 8; including top eye 14 for attachment to the crane, lower eye/hook 17 for attachment to the load, compressible fluid pressure gauge 22, upper and lower heads, 13 and 15, respectively, and piston rod 31. FIGS. 9 and 10 depict the new and improved remote control addition to the auxiliary hoist control 11.

In FIG. 9, there is illustrated a hoist control transceiver/battery housing 202 and a motor, pulley, cam housing 204, mounted on a base plate 205, both housings mounted separately or integrally together on the auxiliary hoist control body 12. FIG. 9 also describes the related remote hand control transceiver/battery housing 206. Constant communication is made between hand controller transceiver 206 and hoist controller transceiver 202 by means of pairs of antenna 208 and 210, respectively.

Referring now to the transparent view of FIG. 10, an up motor 212 controlled by lead 213 from transceiver 202 operates on command to turn a first up pulley 214 which turns belt 216 to turn a second up pulley 218 that in turn operates on an up cam 220 in a cam housing 221 to cause piston 31 to be retracted as discussed in more detail infra. A down motor 222 controlled by lead 223 from transceiver 202 operates on command to turn a first down pulley 224 which turns belt 226 to turn a second down pulley 228 that in turn operates on a down cam 230 to cause piston 31 to be extended as discussed in more detail infra.

Figure 11:
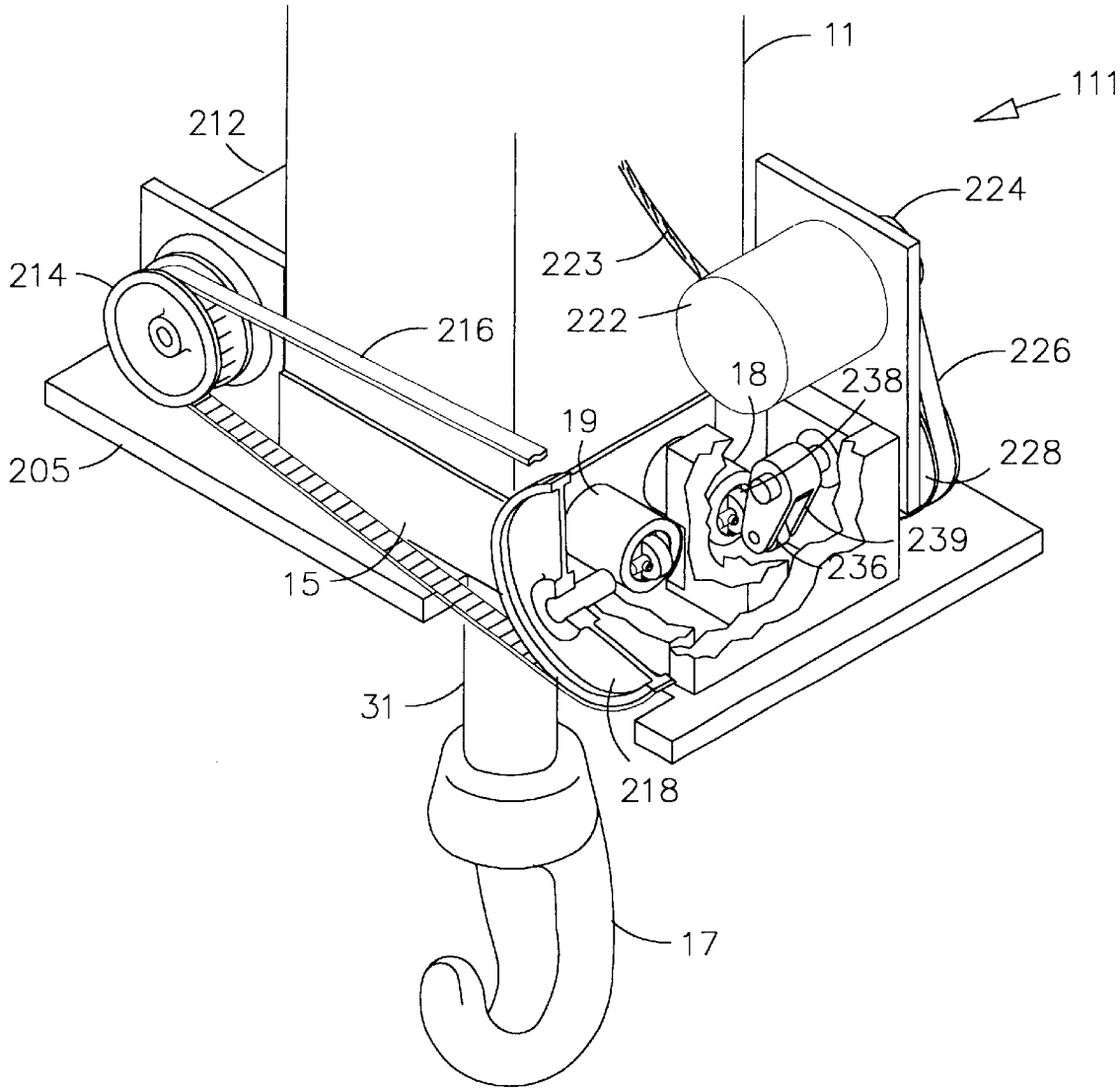
FIG. 11 is a cut-away, perspective view of the Load Positioner Controller Unit illustrating the unique cam elements that operate on the down valve and up pump assemblies.

FIG. 11 is another view of FIG. 10 with a cut away view of the cam housing 221 to more clearly illustrate the operability of the RF remotely activated cams on the up pump assembly 19 of FIG. 5 and the down valve assembly 18 of FIG. 6. For purposes of simplicity, only the down valve assembly cam 230 is illustrated; however, up pump assembly 18 and cam 220 would operate in the same manner. On receiving a "lowering signal" on down lead 223, motor 222 will turn on turning first down pulley 224 which turns second down pulley 228 causing down cam 230 an cam axle 232 to turn clockwise, turn upward. Cam 230 consists of a forked arm 234 with a roller bearing 236 disposed between each fork. On turning upward roller bearing 236 is impressed upon a second roller bearing 238. Second roller bearing 238 is fixedly mounted at the end of down valve assembly 18 piston head thereby causing the piston to be pushed into the valve assembly 18 in similar manner that the down valve assembly handle 123 turning along slanted slot 128 would force the valve piston inward and thereby will pass hydraulic fluid as described supra to allow the load bearing piston extension 31 to lower a load.

Figure 12:
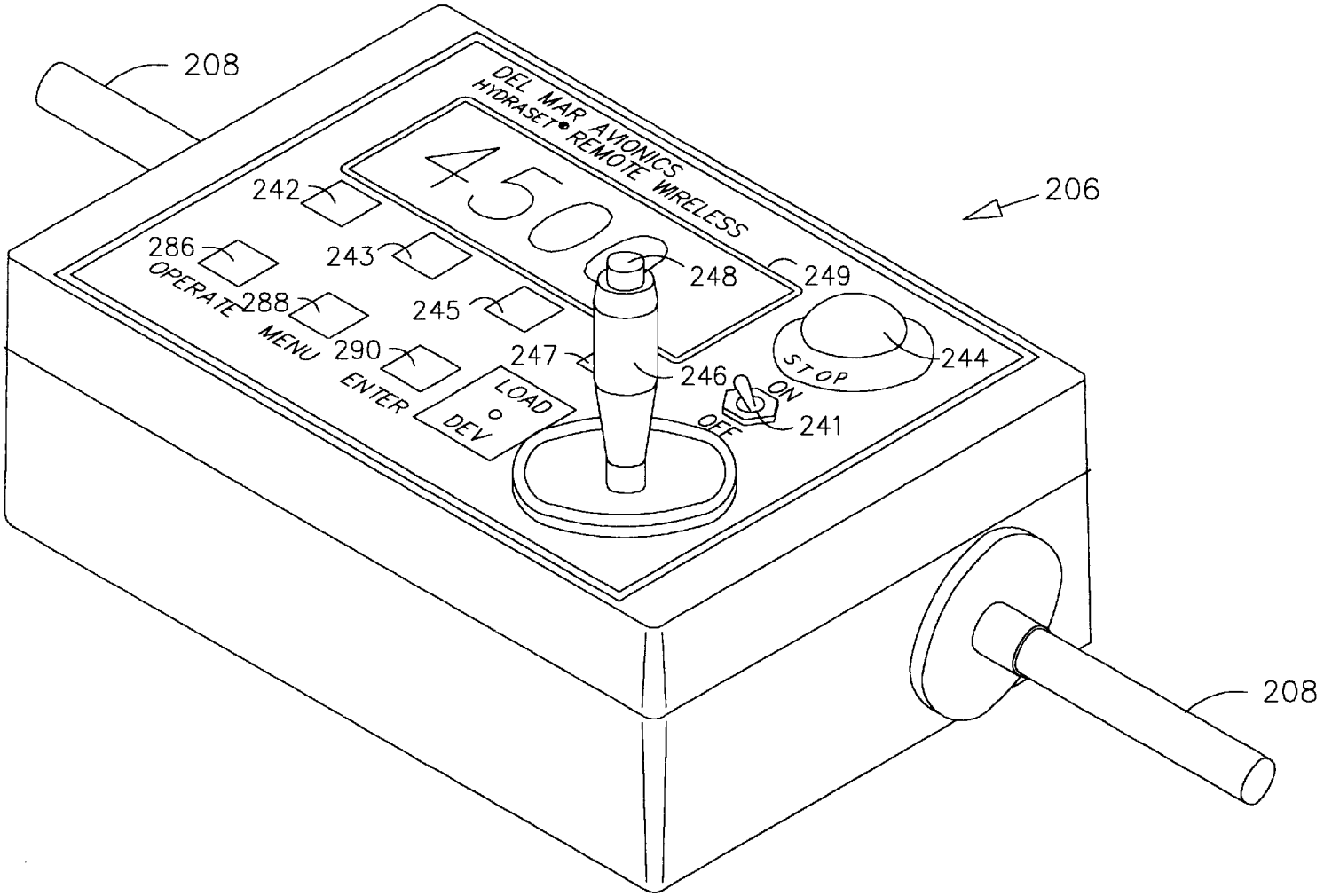
FIG. 12 is an enlarged perspective view of the Hand Control Unit of FIG. 9.

Referring now to FIG. 12, a description of the hand control housing 206 will be briefly explained. Hand control housing transceiver 206 is coupled by RF means to the hoist control transceiver housing 202 by a pair of antennas 208. Information, processes and data can be simultaneously displayed in digital form on the LCD display 240 and may also be displayed on the digital LCD 21 on the load positioner 11. Four "soft" function keys 242 utilize LCD 240 for sequential operation of functions thereon, discussed more fully infra. Other keys are addressed as appropriate: Operate, Menu, Enter, Load/Dev. A toggle On/Off button 242 and an Emergency Stop button 244 are conveniently placed along the right hand side of the control module 206. The Up/Down joy stick/toggle 246 elevates and lowers a load in discrete increments as described infra, and only when active button 248 is depressed.

Figure 13:
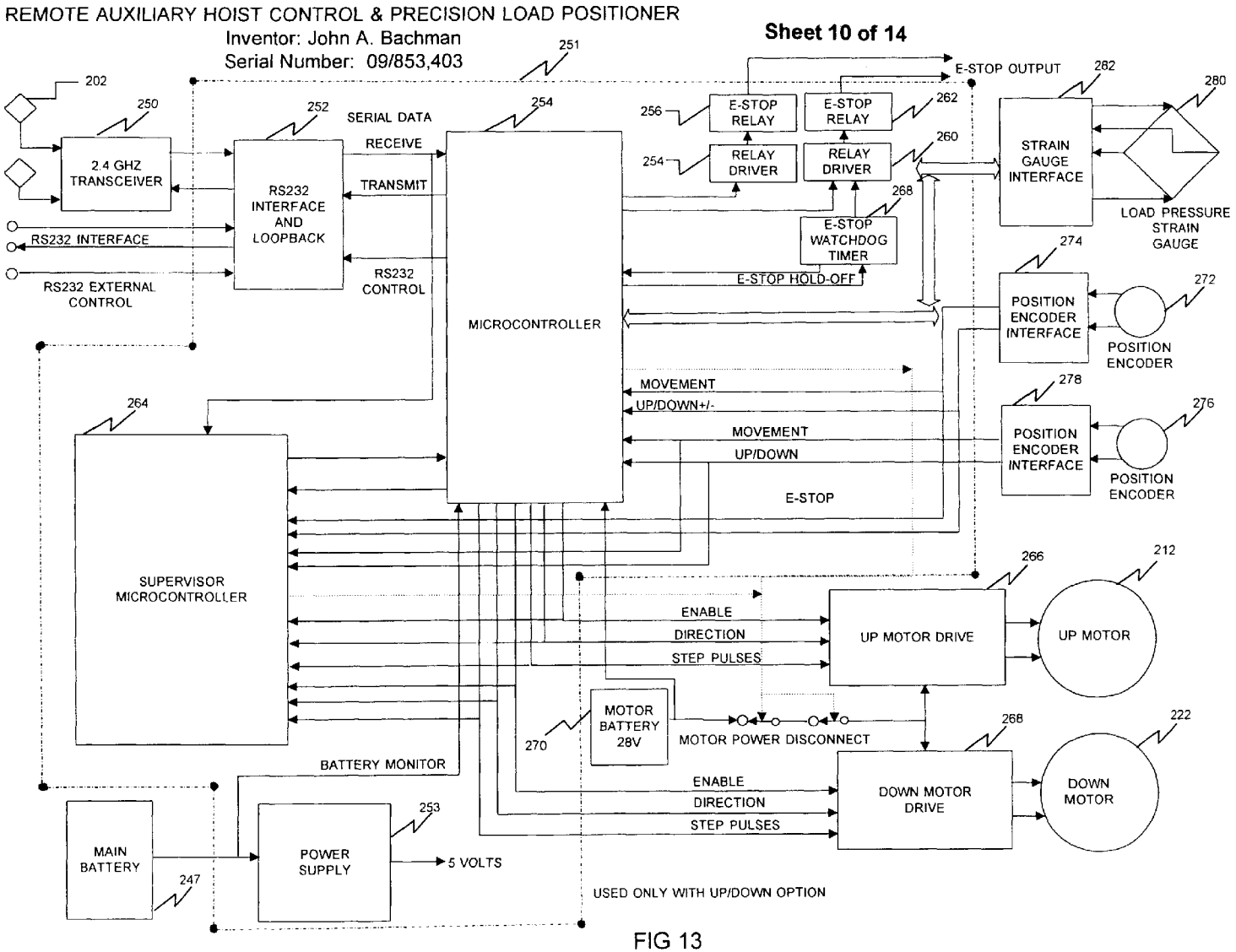
FIG. 13 is a block flow diagram of the electronic schematic of the Load Positioner Controller Unit.

FIG. 13 describes the controller unit transceiver 202 electronic package. The electronic package lies on a printed circuit board (PCB) within the transceiver controller unit housing 202 of FIG. 9 and is disclosed and enclosed within a dashed line 251 in FIG. 13. All transceiver components are powered by an independent 14.5 volt battery 247 and power supply 253 to yield a 5 volt power source for the entire PCB. Antenna 202 is coupled to a 2.4 GHz transceiver 250 which transmits and receives serial data from the hand controller 206 through an RS232 interface and loopback port 252 to a microprocessor/microcontroller 254. An emergency stop E-STOP can be effected from hand control unit 206 through microprocessor 254 to stop all vertical movement of the load positioner 111 through relay driver 254 which commands emergency stop relay 256. A back emergency stop, watchdog timer 258, exists to stop load positioner travel in the event there is a breakdown in steady communication between the hand unit transceiver 206 and the load positioner transceiver 202. In the event there may arise a break down between the two transceivers, and within a designated time interval, a second e-stop relay driver 260 will command a second e-stop relay 262 to close down the system and stop all vertical movement of the load positioner 111. A second microprocessor serves as a supervisor microcontroller 264. Microcontroller 264 serves as another "fail safe" feature of the system by monitoring all inputs and relative outputs of microprocessor 254. On receiving an up command from hand unit 206, microcontroller 254 outputs a respective up command to Up Motor Drive 266 to cause Up Motor 212 to turn on, reference FIG. 10, to cause cam 220 to rotate thereby activating up pump assembly 19, reference FIG. 5, and causing piston 31 to rise. Correspondingly, on receiving a down command from hand unit 206, microcontroller 254 outputs a respective down command to Down Motor Drive 268 to cause Down Motor 222 to turn on, reference FIG. 5, to cause cam 230 to rotate thereby activating Down Valve Assembly 18, reference FIG. 5, and causing piston 31 to fall. Motor drives are provided power from a common 28 volt battery 270. Position and linear travel of the load positioner 11 is constantly read by a first position encoder 272 in load positioner 11 and passed to microcontrollers 254 and 264 through a position encoder interface 274. A redundant, fail safe second position encoder 276 is also utilized in the system to pass what should be identical data through a second position encoder interface 278 again to redundant microcontrollers 254 and 264. Load weight is obtained via a strain gauge 280 located in the load positioner 11. The strain gauge readings are passed through a strain gauge interface 282 to microcontroller 254.

Figure 14:
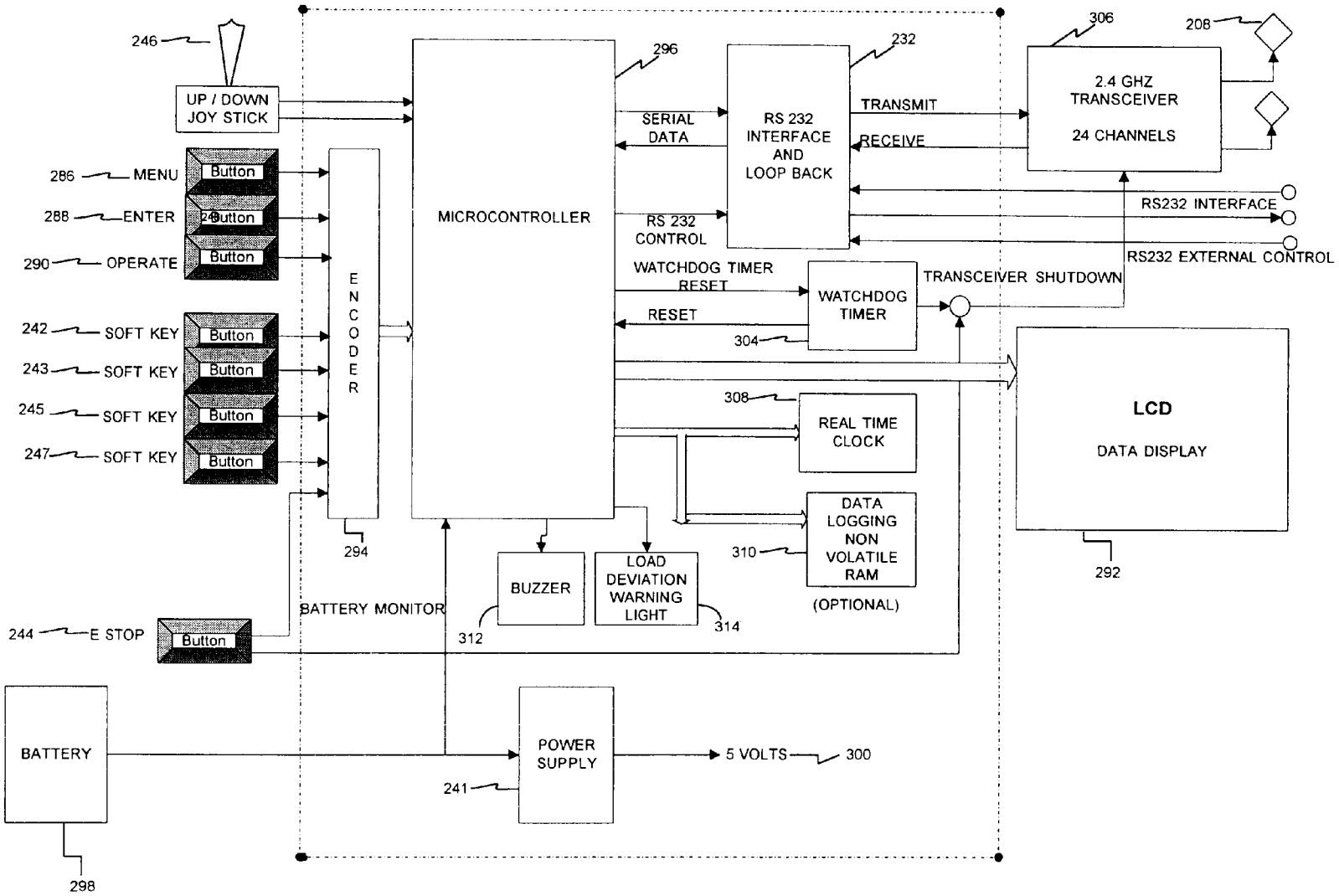
FIG. 14 is a block flow diagram of the electronic schematic of the Hand Control Unit.

FIG. 14 describes the electronic components on a PCB enclosed within Hand Control Unit 206. The dashed line 284 encompasses all Hand Control electronic components on the PCB. Referring to FIGS. 12 and 14, it can be observed that all operator inputs are made on Hand Control Unit 206 through three designated buttons, Menu 286, Enter 288, Operate 290, through four soft key buttons, 242, 243, 245, 247, the identification of which is obtained on the LCD Display 292, through an up/down Joystick 246, and through emergency stop button 244. All button input passes through an encoder 294 into a micro processor, Micro Controller 296. The entire PCB is powered by a 14.5 volt battery 298 coupled through a power switch 241 to a 5 volt output power supply 300. An RS232 debug and test interface and loop back element 232 is disposed between micro controller 296 and the 2.4 GHz transceiver coupled to antenna 208. A fail safe watchdog timer element 304 communicates and monitors communication between the Controller Unit 111 and the hand control unit 206. If a set time period has lapsed, watchdog timer 304 will command the Controller Unit 111 to shut down. Transceiver shutdown may be effected automatically or by operator command from e stop button on the console passing through a common element, transceiver shutdown 306, to 2.4 GHz transceiver 306 and over antenna 208 to antenna 210 of the load positioner. The system is provided with a Real Time Clock 308 coupled to microcontroller 296 and to a Non Volatile RAM 310 to have a full record of all data input and related output activities. The Hand Control Unit 206 may also be provided with a Warning Buzzer 312 and a Load Deviation Warning Light 314, coupled to microcontroller 296.

Figure 15:
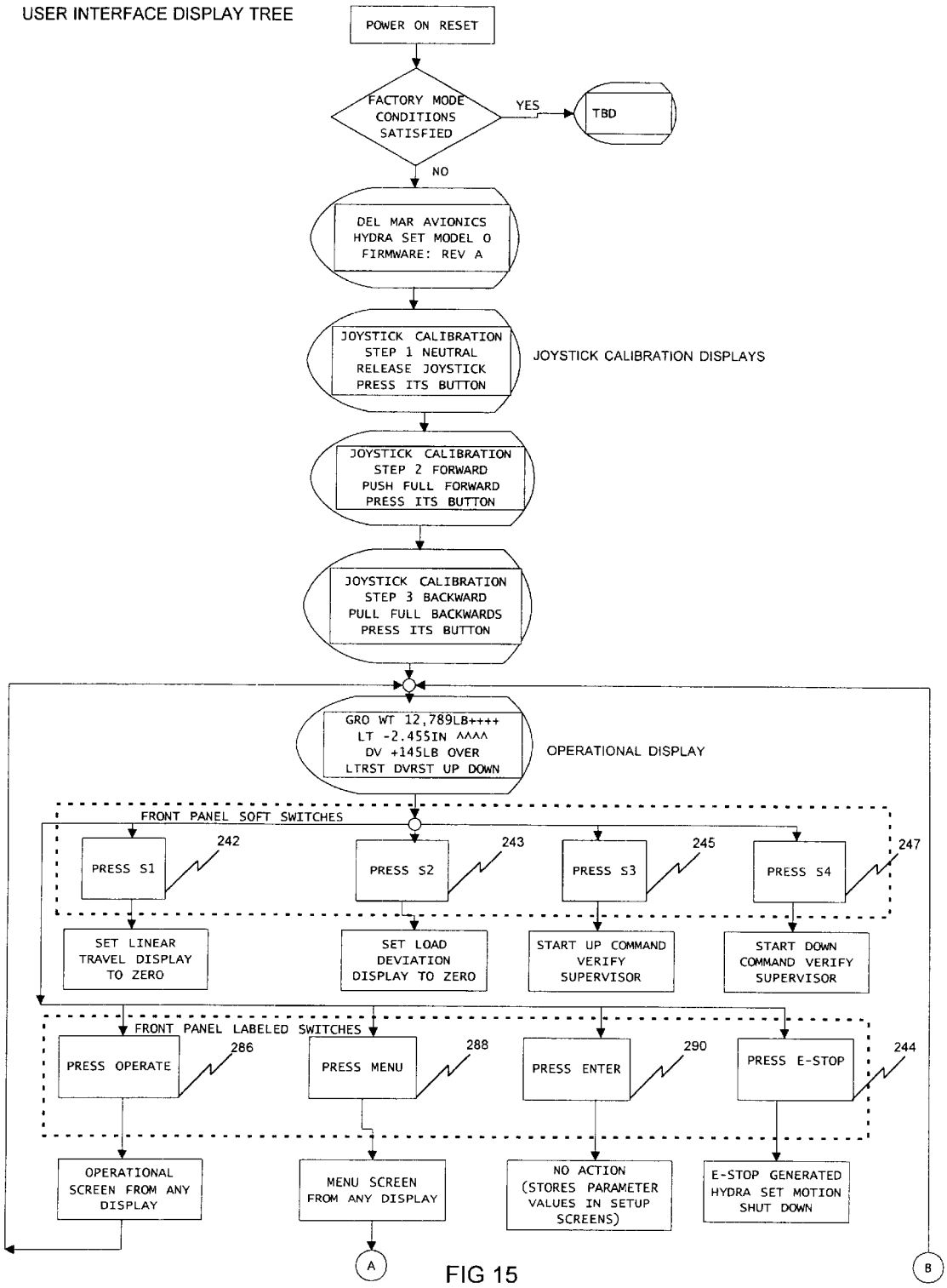
FIG. 15 is a flow chart of the user Interface Display Tree delineating the Joystick Calibration Display and the Operational Display.
Figure 16:
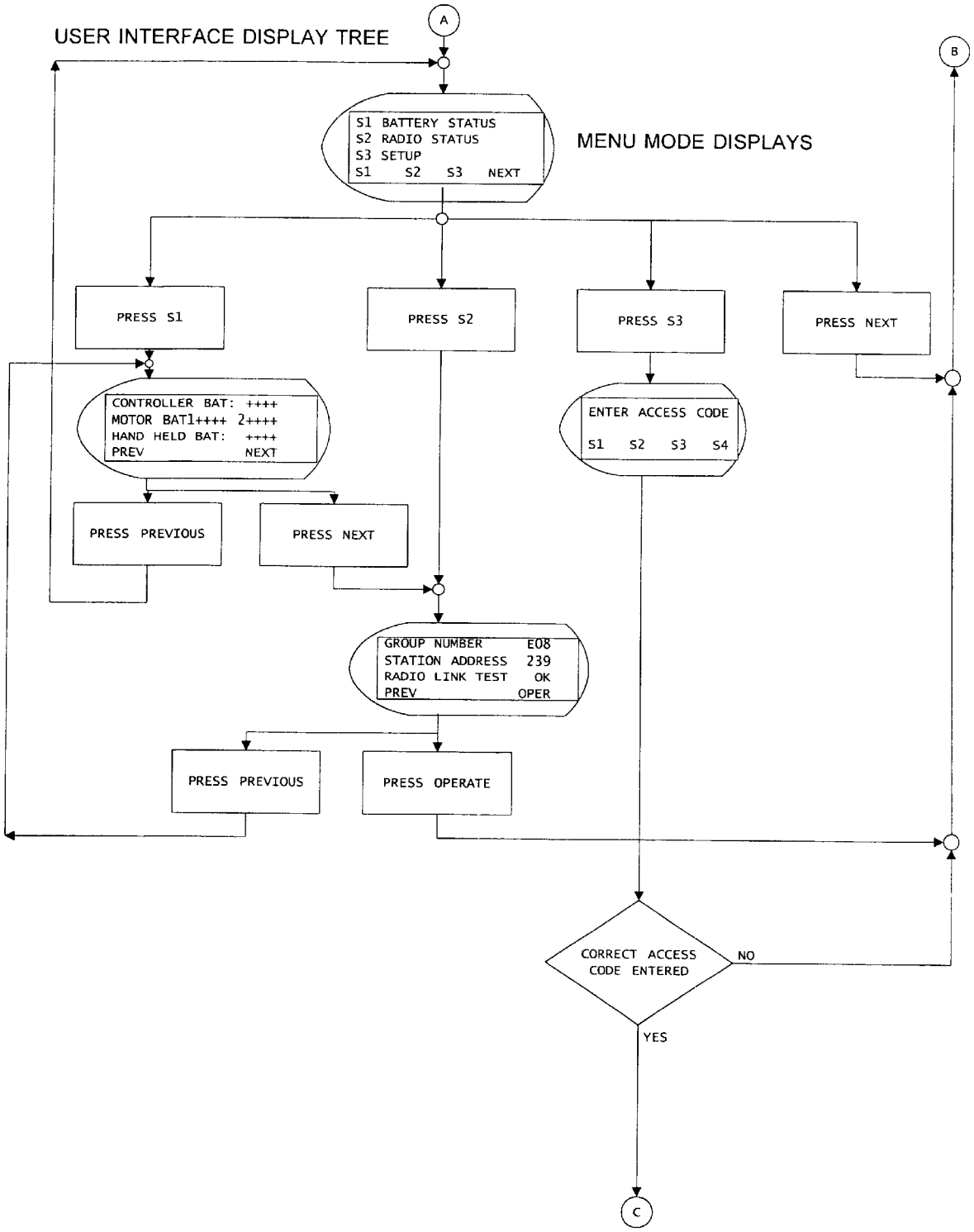
FIG. 16 is a flow chart of the user Interface Display Tree delineating the Menu Mode Display.
Figure 17:
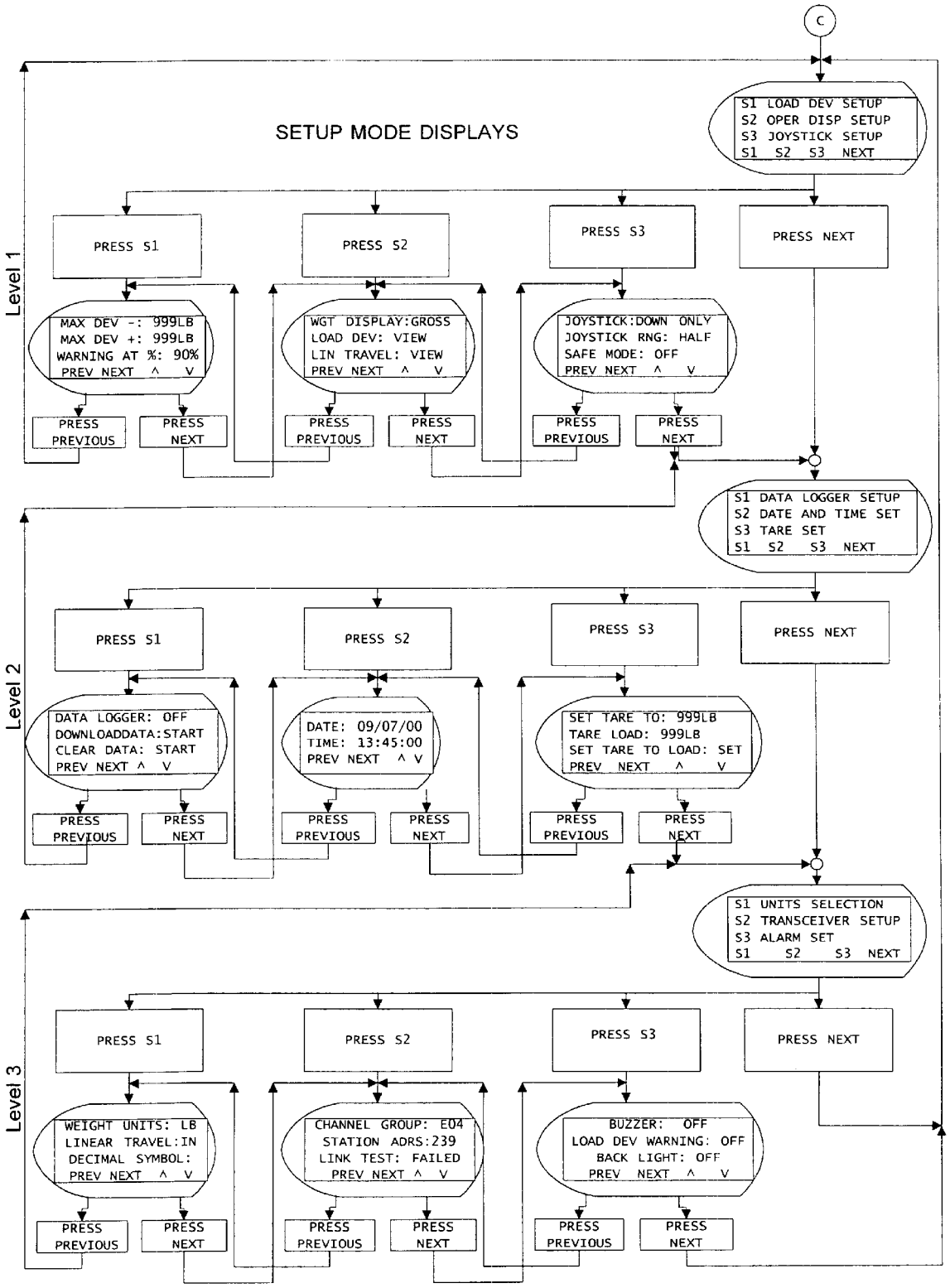
FIG. 17 is a flow chart of the user Interface Display Tree delineating the Setup Mode Display.

Referring now to FIGS. 15, 16, and 17, the input and output of the User Interface Display 249 on Hand Control Unit 206 is illustrated in flow chart form. In FIG. 15, each elliptical box displays the successive output displayed on LCD 249. On power up or power reset, automatic calibration of the joystick 246 is made in the progression as illustrated in the Joystick Calibration Display sequence. In the Operational Display section of FIG. 15, it can be observed that pressing S1, soft key button 242, will set the Linear Travel Fcn to "0", pressing soft key S2 (243) will set Load Deviation to "0", pressing soft key S3 (245) will start "up" command verify supervisor, and pressing soft key S4 (247) will start "down" command verify supervisor. Correspondingly, the Labeled Switches function as follows: pressing "Operate" button 286 takes you back to the start up screen, operational display that displays Gross Weight, Linear Travel, Load Deviation, and Linear Travel and Deviation Reset, and the Up Down commands. Pressing the Menu button 288 takes you to a Menu screen. Pressing the Enter button yields no action. Pressing the emergency stop button shuts down the entire system.

FIG. 16 depicts the Menu Mode Display on LCD 249. After getting into Menu Mode through Menu Key 288, Battery Status can be obtained on Soft Key S1 (242),and Radio Status can be obtained through soft key S2 (243). Pressing soft key S3 performs a Reset and takes the operator to the various Menu Modes of FIG. 17. Pressing soft key S4 (247) takes the operator back to the Operational Display of FIG. 15.

FIG. 17 delineates the various Menu Setup Modes of the system. FIG. 17 flow chart is self explanatory in that pressing soft keys S1, S2 or S3 will yield three variable outputs on the first level, dealing with Maximum Deviation, Weight Display, and Joystick movement, respectively. Pressing S4 will take the operator to the second level where pressing S1, S2, and S3 will yield Data Logger, Date, and Tare Load, respectively. Pressing soft key S4 again will take the operator to the third tier/level. Pressing soft keys S1, S2, and S3 will now yield Weight Units, Channel Group, and Buzzer, respectively. Pressing S4 now will take the operator back to the initial Operational Display.

Although the foregoing provides a somewhat detailed description of the invention disclosed, obvious embodiments, alterations and improvements are considered a part of the invention as well. The true scope and extent of the invention concept will be more clearly defined and delineated by the appended claims.

We claim:

1. In an existing hoist control and tension measuring device comprising a first cylinder, a piston contained within the first cylinder, a second cylinder of greater diameter than the first cylinder positioned about the first cylinder to form an annulus therebetween, an upper head closing the upper ends of the first and second cylinders and having an atmospheric vent extending therethrough to the first cylinder and a pressure sealed inlet extending therethrough to the annulus, an eye attached to the upper head, a lower head closing the lower ends of the first and second cylinders and having first and second parallel cylindrical bores extending laterally therethrough perpendicular to the cylinders, with passages connecting each bore with the first cylinder and each bore with an annulus, a piston rod connected to the piston and extending through the lower head to connect with a lower eye, a solid brass separator ring mounted in the annulus so as to divide the annulus into two portions, a hydraulic fluid contained in the cylinder between the piston and the lower head, a hydraulic fluid contained in the annulus between the separator ring and the lower head, a compressible fluid contained in the annulus between the separator ring and the upper head, each down valve assembly, positioned in the first lower head bore, said assembly having an inlet positioned to allow passage of hydraulic fluid from the cylinder into the valve and an outlet positioned to allow passage of hydraulic fluid from the valve into the annulus through the passages connecting the first bore to the cylinder and the annulus, and a valve including as a first integral unit a valve seat having an orifice and an extended tubular aligning section positioned between the orifice and the first bore inlet and as a second integral unit a valve piston consisting of a frusto-conical piston head positioned in said orifice and opening onto a shoulder of a substantially rectangular valve body contained within the tubular aligning section, the rectangular valve body terminating in a cylindrical stem located adjacent the first bore inlet, a helper spring compressively held against said cylindrical stem so as to urge the shoulder against said cylindrical stem so as to urge the shoulder against the inlet side of the orifice to form a seal when the hydraulic pressure in the annulus does not exceed the hydraulic pressure in the cylinder, and wherein the improvement comprises a Radio Frequency, remotely activated electromechanical valve actuating means, in which the down valve actuating means is operated a great distance from the valve and is selectively operable to displace the piston head longitudinally in the direction of the down valve inlet to permit passage of hydraulic fluid through the annular volume thereby formed between the orifice and the piston head, an up pump assembly in the second bore and comprising an inlet allowing passage of hydraulic fluid from the annulus to a first ball check valve through the passage connecting the second bore to the annulus and an outlet allowing passage of hydraulic fluid from a second ball check valve into the cylinder through the passage connecting the second bore to the cylinder, in which the two ball check valves are spring loaded to urge the balls toward the inlet so as to close the valves and form a hydraulic fluid storage space between the valves, and a Radio Frequency, remotely activated electromechanical pump actuator means for selectively moving the first ball check valve toward the second bore to compress the hydraulic fluid stored between the two balls, whereby the second ball check valve opens and a portion of the compressed hydraulic fluid flows into the cylinder, said actuator means thereupon being operable to return under the first ball check valve to its original position, whereby the first ball check valve opens and hydraulic fluid is extracted from the annulus into the hydraulic fluid storage space between the two valves, a first pressure gauge operable to indicate the pressure of the hydraulic fluid in the cylinder, and a second pressure gauge operable to indicate the pressure of the compressible fluid in the annulus.

2. In an auxiliary hoist control comprising a first cylinder, a piston contained within the first cylinder, a second cylinder of greater diameter than the first cylinder positioned about the first cylinder to form an annulus therebetween, an upper head closing the upper ends of the first and second cylinders and having an atmospheric vent extending therethrough to the first cylinder and a pressure sealed inlet extending therethrough to the annulus, first attaching means connected to the upper head, a lower head closing the lower ends of the first and second cylinders and having first and second parallel cylindrical bores extending laterally therethrough perpendicular to the cylinders, at least one fluid passage connecting each bore with the first cylinder and each bore with the annulus, a piston rod connected to the piston and extending through the lower head, second attaching means connected to the piston rod remote from the piston, an integral metallic separator ring mounted in the annulus so as to divide the annulus into a hydraulic fluid portion between the separator ring and the lower head and a compressible fluid portion between the separator ring and the upper head, a down valve assembly positioned in the first lower head bore, said assembly having an inlet positioned to allow passage of hydraulic fluid from the cylinder into the valve and an outlet positioned to allow passage of hydraulic fluid from the valve into the annulus through the passages connecting the first bore to the cylinder and the annulus, and a valve including as a first integral unit a valve seat having an orifice and an extended tubular aligning section positioned between the orifice and the first bore inlet and as a second integral unit a valve piston consisting of a frusto-conical piston head positioned in said orifice and opening onto a shoulder of a substantially rectangular valve body contained within the tubular aligning section, the rectangular valve body terminating in a cylindrical stem located adjacent the first bore inlet, a helper spring compressively held against said cylindrical stem so as to urge the shoulder against the inlet side of the orifice to form a seal when the hydraulic pressure in the annulus does not exceed the hydraulic pressure in the cylinder, and wherein the improvement comprises a remotely controlled RF electromechanical valve actuating means, in which the down valve actuating means is remotely activated and is selectively operable to displace the piston head longitudinally in the direction of the down valve inlet to permit passage of hydraulic fluid through the annular volume thereby formed between the orifice and the piston head and an up pump assembly in the second bore and comprising an inlet allowing passage of hydraulic fluid from the annulus to a first ball check valve though the passage connecting the second bore to the annulus and an outlet allowing passage of hydraulic fluid from a second ball check valve into the cylinder through the passage connecting the second bore to the cylinder, in which the two ball check valves are spring loaded to urge the balls toward the inlet so as to close the valves and form a hydraulic fluid storage space between the valves, and pump actuator means for selectively moving the first ball check valve toward the second bore to compress the hydraulic fluid stored between the two balls, whereby the second ball check valve opens and a portion of the compressed hydraulic fluid flows into the cylinder, said actuator means thereupon being operable to return under the first ball check valve to its original position, whereby the first ball check valve opens and hydraulic fluid is extracted from the annulus into the hydraulic fluid is extracted from the annulus into the hydraulic fluid storage space between the two valves.

* * * * *